US010465367B2

(12) United States Patent
Ogawa et al.

(10) Patent No.: US 10,465,367 B2
(45) Date of Patent: Nov. 5, 2019

(54) SANITARY WASHING DEVICE AND METHOD FOR ASSEMBLE THE SAME

(71) Applicant: TOTO LTD., Kitakyushu-shi, Fukuoka (JP)

(72) Inventors: Takuya Ogawa, Kitakyushu (JP); Yuta Shinden, Kitakyushu (JP); Sho Kiyama, Kitakyushu (JP); Nozomu Okada, Kitakyushu (JP); Sachiko Niwano, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/887,050

(22) Filed: Feb. 2, 2018

(65) Prior Publication Data

US 2018/0216332 A1 Aug. 2, 2018

(30) Foreign Application Priority Data

Feb. 2, 2017 (JP) ..... 2017-017823

(51) Int. Cl.

| | |
|---|---|
| ***E03D 9/08*** | (2006.01) |
| ***A47K 13/12*** | (2006.01) |
| ***A47K 13/28*** | (2006.01) |
| ***E03D 11/13*** | (2006.01) |
| ***A47K 13/24*** | (2006.01) |

(52) U.S. Cl.

CPC ..... *E03D 9/08* (2013.01); *A47K 13/12* (2013.01); *A47K 13/28* (2013.01); *A47K 13/24* (2013.01); *E03D 11/13* (2013.01)

(58) Field of Classification Search

CPC ..... E03D 9/08

USPC ..... 4/420.4, 443

See application file for complete search history.

(56) References Cited

U.S. PATENT DOCUMENTS

| | | | |
|---|---|---|---|
| 2004/0068785 | A1 | 4/2004 | Tomita et al. |
| 2009/0217447 | A1 | 9/2009 | Matsushita et al. |
| 2015/0313426 | A1 | 11/2015 | Cheng et al. |

FOREIGN PATENT DOCUMENTS

| | | | |
|---|---|---|---|
| JP | 07-35583 | U | 7/1995 |
| JP | H09-067847 | A | 3/1997 |
| JP | 2002-242261 | A | 8/2002 |
| JP | 2002-325701 | A | 11/2002 |
| JP | 2006-283400 | A | 10/2006 |
| JP | 2007-209642 | A | 8/2007 |
| JP | 2009-077928 | A | 4/2009 |
| JP | 2009-167588 | A | 7/2009 |
| JP | 2009-167627 | A | 7/2009 |

(Continued)

*Primary Examiner* — Christine J Skubinna

(74) *Attorney, Agent, or Firm* — Pearne & Gordon LLP

(57) ABSTRACT

According to one embodiment, a sanitary washing device includes base and case plates, a case cover, a pivotally supporting unit, and a back cover. The base plate is fixed to a rear part of a toilet bowl. The case plate mounts a washing function part washing a private part of a human body. The case cover covers the washing function part and is fixed onto the case plate. The pivotally supporting unit includes first and second pivotally supporting parts and is fixed to the base plate. The back cover is provided backward the pivotally supporting unit. Front and rear parts of the base plate are fixed to the toilet bowl via first and second position adjusting unit. The case plate is fixed to the base plate via a third position adjusting unit. A fourth position adjusting unit is provided between the pivotally supporting unit and the back cover.

11 Claims, 5 Drawing Sheets

(56) References Cited

FOREIGN PATENT DOCUMENTS

| | | | |
|---|---|---|---|
| JP | 2016-043138 | A | 4/2016 |
| TW | 274721 | B | 4/1996 |
| TW | 201004597 | A | 2/2010 |

SANITARY WASHING DEVICE AND METHOD FOR ASSEMBLE THE SAME

CROSS-REFERENCE TO RELATED APPLICATIONS

This application is based upon and claims the benefit of priority from Japanese Patent Application No. 2017-017823, filed on Feb. 2, 2017; the entire contents of which are incorporated herein by reference.

FIELD

Embodiments described herein relate generally to a sanitary washing device and a method for assemble the same.

BACKGROUND

JP 2016-43138 A (Kokai) discusses a toilet apparatus including a toilet bowl provided with a toilet bowl accessories such as a base member, a functional component, a hinge mechanism or the like. In the toilet apparatus, the respective toilet bowl accessories are configured as another body, and the toilet apparatus is configured by fixing these toilet bowl accessories to the toilet bowl.

When the toilet bowl accessories are fixed to the toilet bowl, if a gap between the toilet bowl and the respective toilet bowl accessories is large, a sense of unity of the toilet bowl and the toilet bowl accessories is lost, and it looks bad. Therefore, when the toilet bowl accessories are fixed to the toilet bowl, the respective toilet bowl accessories are desired to be fixed so that the gap to the toilet bowl is small.

The invention has been made on the basis of recognition of such a problem, and the purpose is to provide a sanitary washing device which can improve the sense of unity by making the gap between the accessories and the toilet bowl small.

SUMMARY

According to an embodiment, a sanitary washing device includes a base plate, a case plate, a case cover, a pivotally supporting unit, and a back cover. The base plate is fixed to a rear part of a toilet bowl. The case plate is mounted with a washing function part washing a private part of a human body. The case plate is fixed onto the base plate. The case cover covers the washing function part from upward and is fixed onto the case plate. The pivotally supporting unit includes a first pivotally supporting part pivotally supporting a toilet seat and a second pivotally supporting part pivotally supporting a toilet lid. The pivotally supporting unit is fixed to the base plate in a backward of the case plate. The back cover is provided backward the pivotally supporting unit. A front part and a rear part of the base plate are fixed respectively to the toilet bowl via a first position adjusting unit and a second position adjusting unit. The first position adjusting unit and the second position adjusting unit are capable of adjusting a position of the base plate to the toilet bowl. The case plate is fixed to the base plate via a third position adjusting unit capable of adjusting a position of the case plate. A fourth position adjusting unit capable of adjusting a position of the back cover to the base plate is provided between the pivotally supporting unit and the back cover. The back cover is attached to the fourth position adjusting unit.

DETAILED DESCRIPTION

Figure 1A:
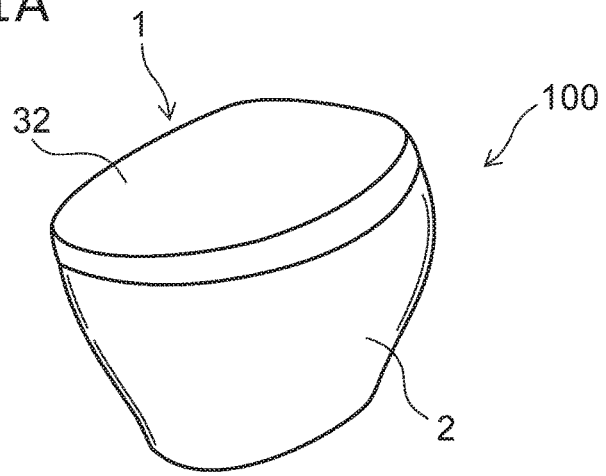
FIG. 1A to FIG. 1C are perspective views showing toilet apparatuses including sanitary washing devices according to an embodiment.

The first invention relates to a sanitary washing device. The sanitary washing device includes a base plate, a case plate, a case cover, a pivotally supporting unit, and a back cover. The base plate is fixed to a rear part of a toilet bowl. The case plate mounts a washing function part washing a private part of a human body. The case plate is fixed onto the base plate. The case cover covers the washing function part from upward and is fixed onto the case plate. The pivotally supporting unit includes a first pivotally supporting part pivotally supporting a toilet seat and a second pivotally supporting part pivotally supporting a toilet lid. The pivotally supporting unit is fixed to the base plate in a backward of the case plate. The back cover is provided backward the pivotally supporting unit. A front part and a rear part of the base plate are fixed respectively to the toilet bowl via a first position adjusting unit and a second position adjusting unit. The first position adjusting unit and the second position adjusting unit are capable of adjusting a position of the base plate to the toilet bowl. The case plate is fixed to the base plate via a third position adjusting unit capable of adjusting a position of the case plate. A fourth position adjusting unit capable of adjusting a position of the back cover to the base plate is provided between the pivotally supporting unit and the back cover. The back cover is attached to the fourth position adjusting unit.

According to the sanitary washing device, the position of the base plate to the toilet bowl and the positions of the case cover and the back cover to the base plate can be adjusted by the first position adjusting unit to the fourth position adjusting unit. These positions are adjusted, and thus it is possible to make a gap between the sanitary washing device and the toilet bowl small, enhance a sense of unity with the toilet bowl of the sanitary washing device, and improve the appearance.

The second invention is the sanitary washing device in the first invention, wherein the first position adjusting unit and the second position adjusting unit are further capable of adjusting an inclination in a front-back direction of the base plate to the toilet bowl.

According to the sanitary washing device, since the inclination in the front-back direction of the base plate to the toilet bowl can be adjusted, the gap produced to the toilet bowl can be smaller and the appearance can be further improved.

The third invention is the sanitary washing device in the first invention or the second invention, wherein the first position adjusting unit and the second position adjusting unit are further capable of adjusting an inclination in a horizontal direction of the base plate to the toilet bowl.

According to the sanitary washing device, since the inclination in the horizontal direction of the base plate to the toilet bowl can be adjusted, the gap produced to the toilet bowl can be smaller and the appearance can be further improved.

The fourth invention relates to a method for assembling a sanitary washing device. The method can include fixing a base plate to a rear part of a toilet bowl while adjusting a position of the base plate to a toilet bowl, a pivotally supporting unit being fixed to the base plate. The pivotally supporting unit includes a first pivotally supporting part pivotally supporting a toilet seat and a second pivotally supporting part pivotally supporting a toilet lid. The method can include fixing a case plate onto the base plate in a frontward of the pivotally supporting unit while adjusting a position of the case plate to the base plate. A washing function part washing a private part of a human body is mounted on the case plate. The method can include fixing a case cover covering the washing function part from upward onto the case plate, and providing a back cover backward the pivotally supporting unit while adjusting a position of the back cover to the base plate.

According to the method for assembling the sanitary washing device, the sanitary washing device can be assembled while adjusting the position of the base plate to the toilet bowl and the positions of the case plate and the back cover to the base plate. For this reason, it is possible to make the gap produced between the sanitary washing device and the toilet bowl small, and to assemble the sanitary washing device having the sense of unity with the toilet bowl and having good appearance.

The fifth invention is the method for assembling the sanitary washing device in the fourth invention, wherein a first position adjusting unit and a second position adjusting unit are fixed to a front part and a rear part of the toilet bowl, respectively while adjusting the position of the base plate to the toilet bowl, and the base plate is fixed to the toilet bowl via the first position adjusting unit and the second position adjusting unit, and thus the position of the base plate to the toilet bowl is adjusted.

According to the method for assembling the sanitary washing device, by using the first position adjusting unit and the second position adjusting unit, the position of the base plate to the toilet bowl can be adjusted more easily and accurately.

The sixth invention is the method for assembling the sanitary washing device in the fifth invention, wherein an inclination of the base plate is adjusted by the first position adjusting unit and the second position adjusting unit, the inclination being in a front-back direction and a horizontal direction of the base plater to the toilet bowl.

According to the method for assembling the sanitary washing device, since the inclination of the base plate to the toilet bowl is adjusted, it is possible to make the gap between the sanitary washing device and the toilet bowl smaller and enhance the sense of unity of the toilet bowl with the sanitary washing device.

The seventh invention is the method for assembling the sanitary washing device in one of the fourth to sixth inventions, wherein a third position adjusting unit is fixed onto the base plate in the forward of the pivotally supporting unit while adjusting the position of the case plate to the base plate, and the case plate is fixed to the base plate via the third position adjusting unit, and thus the position of the case plate to the base plate is adjusted.

According to the method for assembling the sanitary washing device, by using the third position adjusting unit, the position of the case plate to the base plate can be more easily and accurately.

The eighth invention is the method for assembling the sanitary washing device in one of the fourth to seventh inventions, wherein a fourth position adjusting unit is fixed onto the base plate in the backward of the pivotally supporting unit while adjusting the position of the back cover to the base plate, and the back cover is attached to the fourth position adjusting unit, and thus the position of the back cover to the base plate is adjusted.

According to the method for assembling the sanitary washing device, by using the fourth position adjusting unit, the position of the back cover to the base plate can be adjusted more easily and accurately.

Various embodiments will be described hereinafter with reference to the accompanying drawings. In the drawings, the same reference numbers are applied to the same configurational elements and the detailed description will be omitted as appropriate.

In the specification of the application, for description of the invention, "upward", "downward", "forward", "backward", "left lateral", and "right lateral" are used, and these have the case of viewing from the user seating on a toilet seat 31 described later as a reference.

Figure 1B:
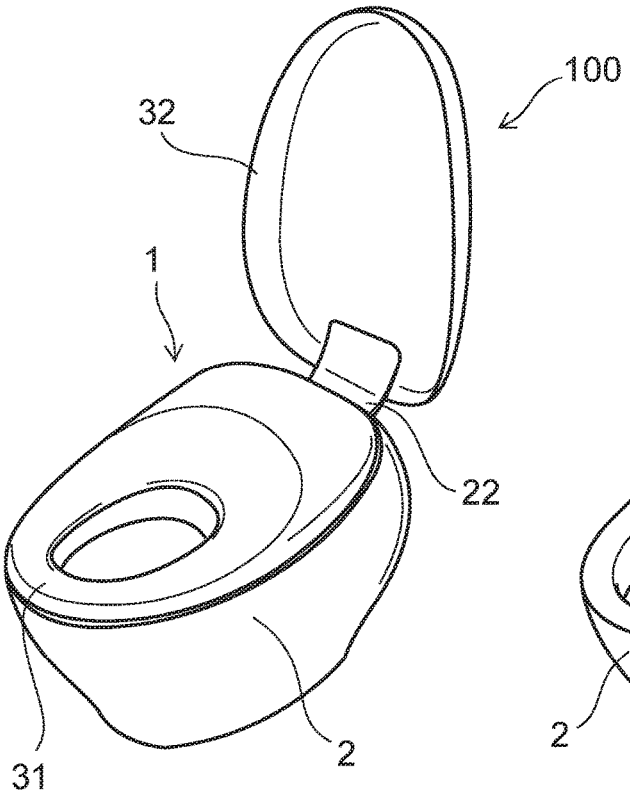
Figure 1C:
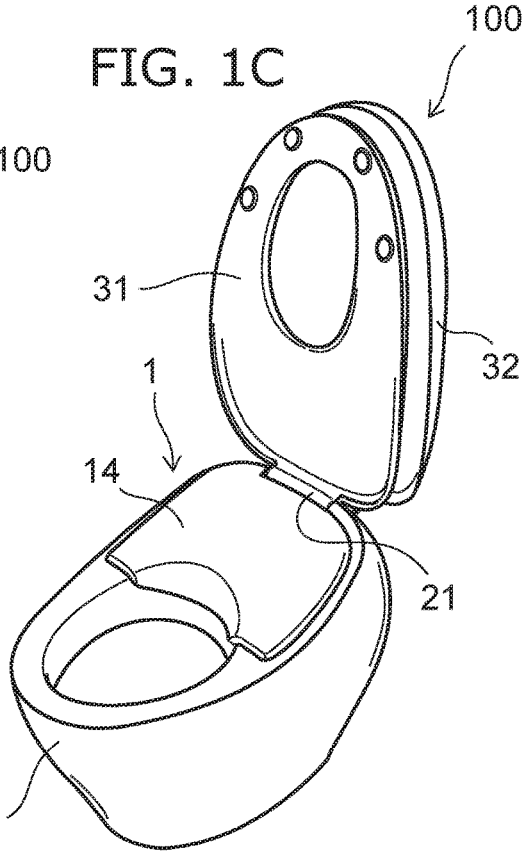
Figure 1C:
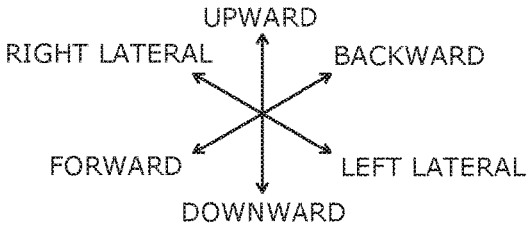

FIG. 1A to FIG. 1C are perspective views showing toilet apparatuses 100 including sanitary washing devices according to an embodiment.

FIG. 1A shows the situation of lowering the toilet seat 31 and closing a toilet lid 32. FIG. 1B shows the situation of lowering the toilet seat 31 and opening the toile lid 32. FIG. 1C shows the situation of raising the toilet seat 31 and opening the toilet lid 32.

As shown in FIG. 1A to FIG. 1C, the toilet apparatus 100 includes a western style toilet sit-down bowl 2 (hereinafter, simply referred to as toilet bowl 2), and a sanitary washing device 1 provided thereon. The sanitary washing device 1 includes a toilet seat 31 and a toilet lid 32.

A rear end of the toilet seat 31 is pivotally supported to the toilet bowl 2 by a first pivotally supporting part 21. A rear end of the toilet lid 32 is pivotally supported to the toilet bowl 2 by a second pivotally supporting part 22. The toilet seat 31 and the toile lid 32 pivotally rotate to the toilet bowl 2 via the first pivotally supporting part 21 and the second pivotally supporting part 22. Thereby, a vertical motion of the toilet seat 31 and an opening and closing motion of the toile lid 32 are performed.

Figure 2:
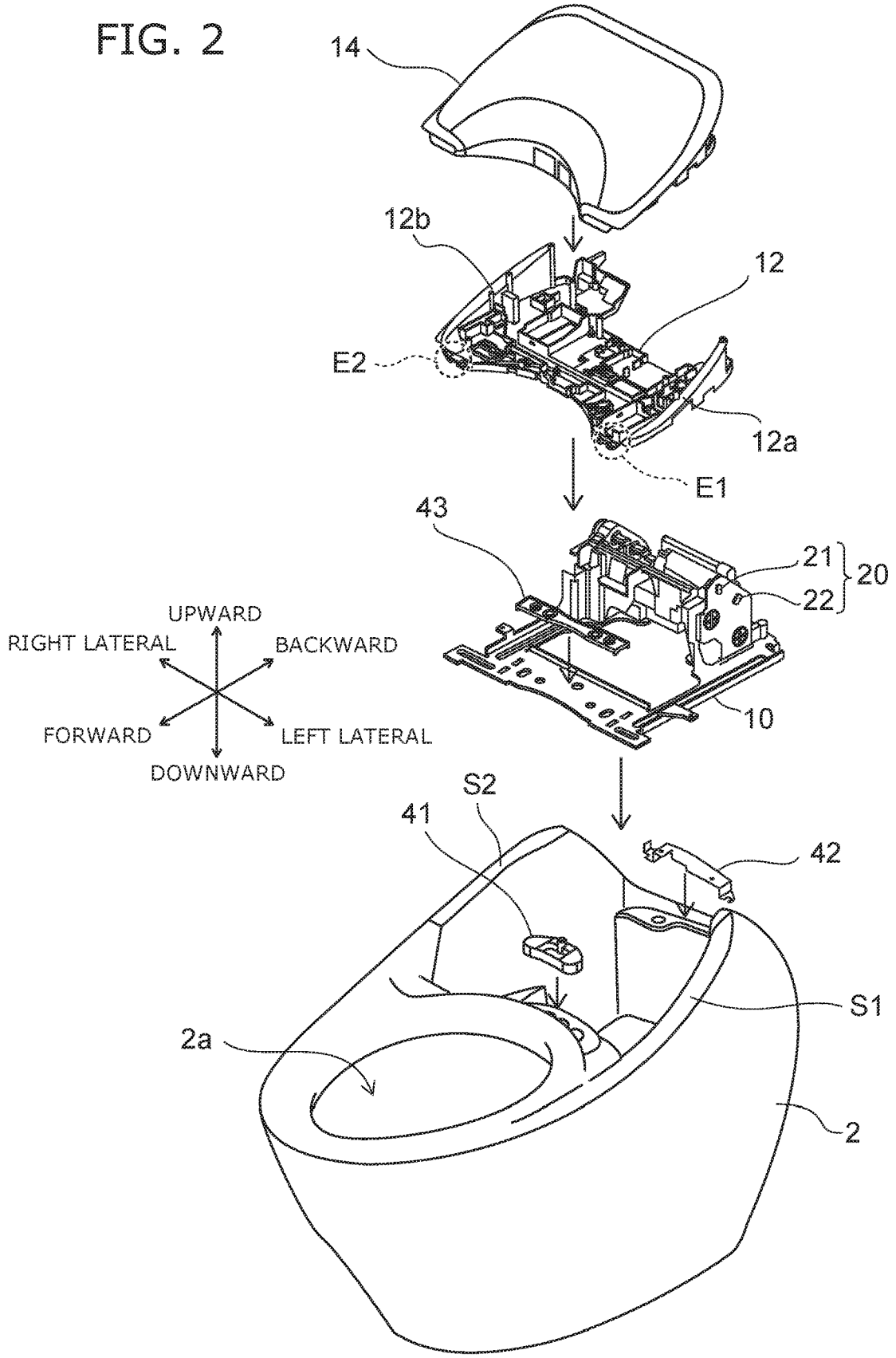
FIG. 2 is a perspective view showing separately a portion of the configurational element of the sanitary washing device according to the embodiment.
Figure 3:
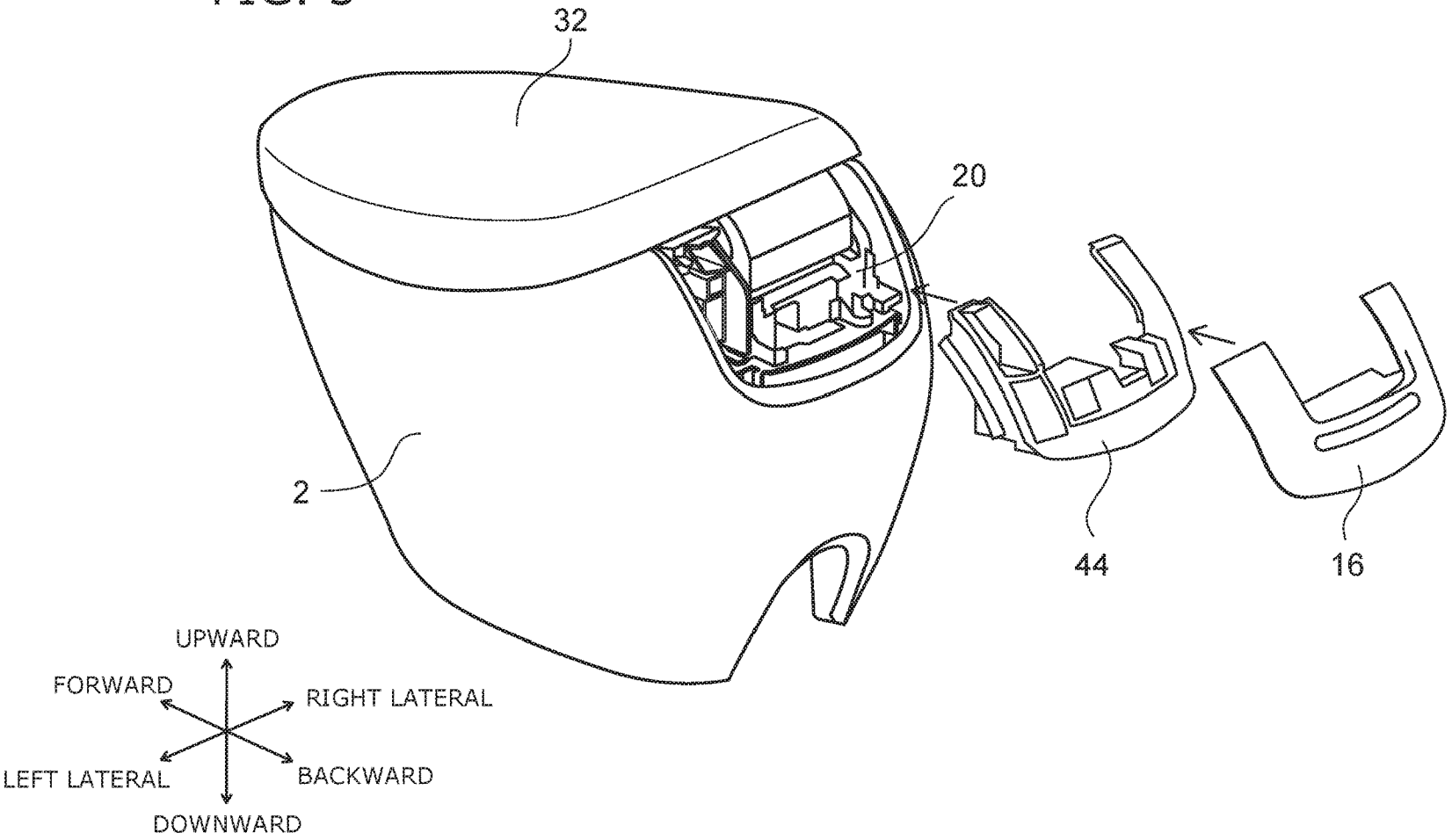
FIG. 3 is a perspective view showing separately a portion of the configurational element of the sanitary washing device according to the embodiment.

FIG. 2 and FIG. 3 are perspective views showing separately portions of the configurational elements of the sanitary washing device 1 according to the embodiment. In FIG. 2, the toilet seat 21 and the toilet lid 32 are omitted.

As shown in FIG. 2 and FIG. 3, the sanitary washing device 1 includes a base plate 10, a case plate 12, a cover plate 14, a back cover 16, and a pivotally supporting unit 20.

The base plate 10 is a plate made of a metal with rigidity. As shown in FIG. 2, a front part of the base plate 10 is fixed to the toilet bowl 2 via a first position adjusting unit 41 near the rear end of an opening 2*a* of the toilet bowl 2. A rear part of the base plate 10 is fixed to the toilet bowl 2 via a second position adjusting unit 42 near the rear end of the toilet bowl 2.

In the rear part of the base plate 10, the pivotally supporting unit 20 is fixed onto the base plate 10. The pivotally supporting unit 20 includes the first pivotally supporting part 21 by which the toilet seat 31 is pivotally supported and the second pivotally supporting part 22 by which the toilet lid 32 is pivotally supported. The pivotally supporting unit 20 is fixed to the toilet bowl 2 via the base plate 10. Thereby, the toilet seat 31 and the toilet lid 32 pivotally supported by the first pivotally supporting part 21 and the second pivotally supporting part 22 pivotally rotate to the toilet bowl 2.

The case plate 12 is fixed onto the base plate 10 in a forward of the pivotally supporting unit 20 via a third position adjusting unit 43. A washing function part for washing a private part of a human body such as "bottom" is mounted on the case plate 12. Other than this, various function parts such as a controller controlling the operation of the respective configurational elements of the sanitary washing device 1, a heat exchanger warming water supplied to the washing function part, and a blower unit for blowing the private part of the human body are appropriately mounted on the case plate 12.

A lower surface of the case plate 12 abuts an upper surface of the base plate 10. A front end E1 on a left lateral and a front end E2 on a right lateral of the case plate 12 are positioned forward from the base plate 10 and placed around the opening 2*a* of the toilet bowl 2.

An upper surface S1 of a left side part and an upper surface S2 of a right side part of the toilet bowl 2 incline upward towards the backward. A left side part 12*a* and a right side part 12*b* of the case plate 12 incline upward towards the backward as well, and are provided on the upper surfaces S1 and S2 of the toilet bowl 2.

The cover plate 14 is fixed onto the case plate 12. The cover plate 14 covers the function part mounted on the case plate 12 from upward. A left side part and a right side part of the cover plate 14 are provided on the upper surface S1 and the upper surface S2 of the side part of the toilet bowl 2, respectively. The left side part and the right side part of the cover plate 14 cover side parts 12*a* and 12*b* of the case plate 12 from upward, respectively.

The back cover 16 is provided backward the pivotally supporting unit 20 as shown in FIG. 3. A fourth position adjusting unit 44 is provided between the back cover 16 and the pivotally supporting unit 20. The fourth position adjusting unit 44 is fixed to the base plate 10. The back cover 16 is attached to the fourth position adjusting unit 44 detachably. The back cover 16 covers the pivotally supporting unit 20 and the fourth position adjusting unit 44 from backward. A surface of the back cover 16 is configured to form a smooth surface together with a back surface of the toilet bowl 2 when attaching the back cover 16.

Here, with reference to FIG. 2 to FIG. 6, a method for assembling the sanitary washing device 1 according to the embodiment will be described.

Figure 4:
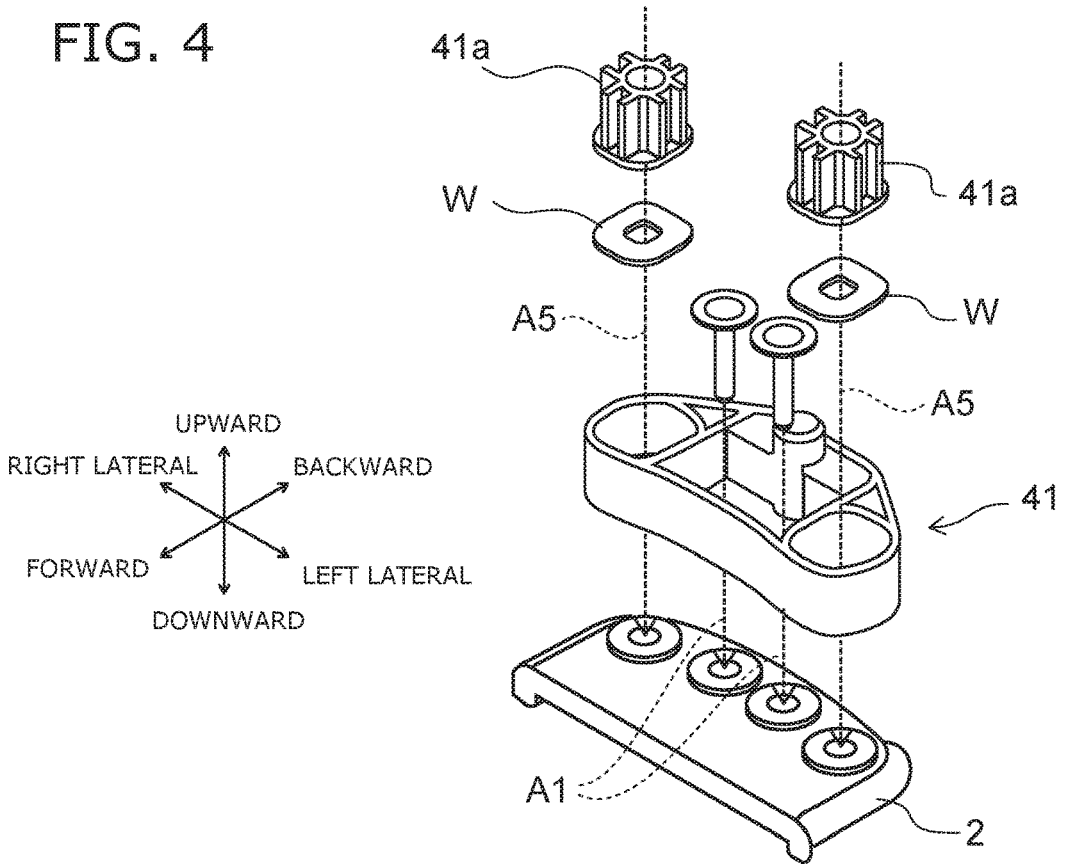
FIG. 4 is a process perspective view showing an assembly process of the sanitary washing device according to the embodiment.
Figure 5:
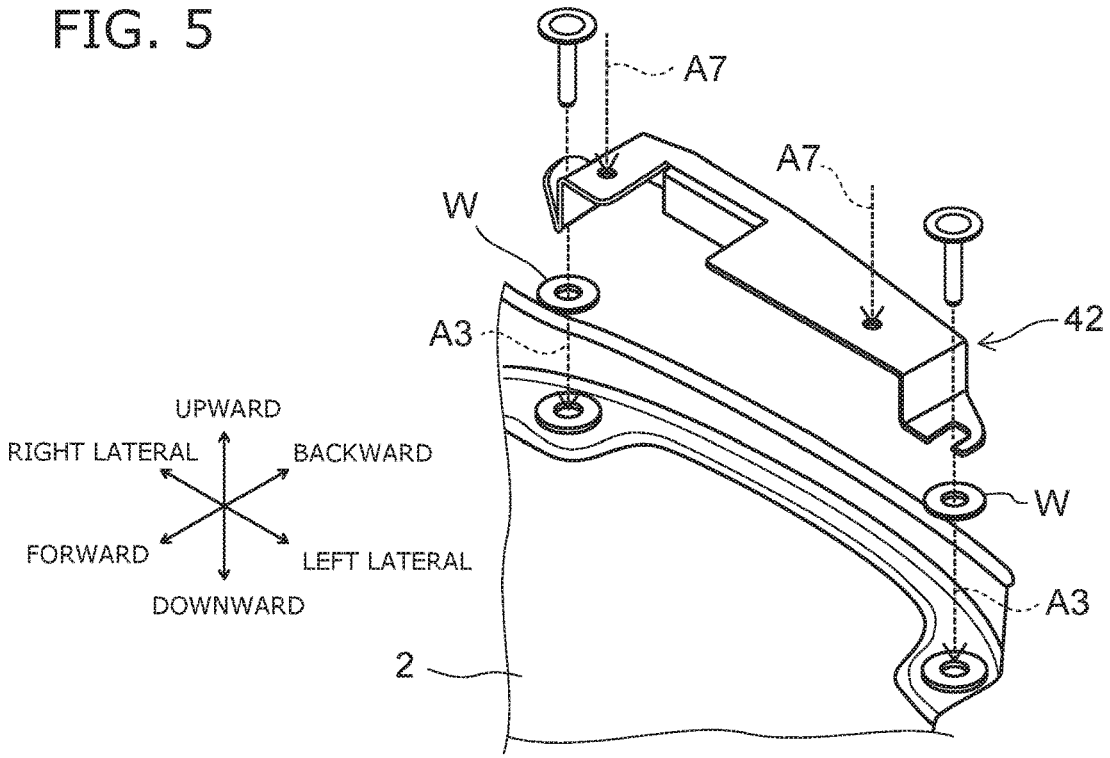
FIG. 5 is a process perspective view showing an assembly process of the sanitary washing device according to the embodiment.
Figure 6:
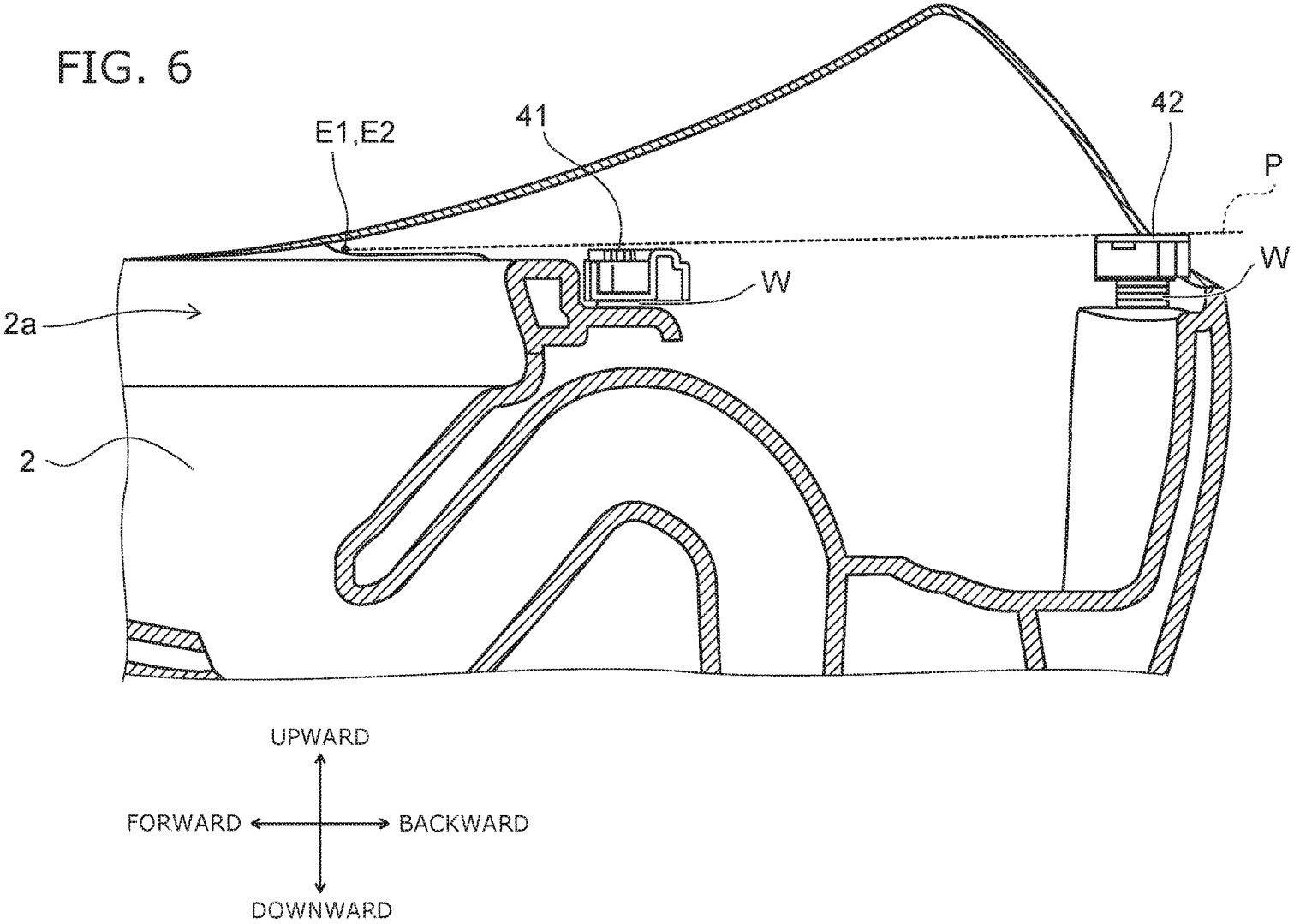
FIG. 6 is a process cross-sectional view showing an assembly process of the sanitary washing device according to the embodiment.

FIG. 4 and FIG. 5 are process perspective views showing an assembly process of the sanitary washing device 1 according to the embodiment. FIG. 6 is a process cross-sectional view showing the assembly process of the sanitary washing device 1 according to the embodiment.

FIG. 4 shows an appearance of the first position adjusting unit 41 and a portion of the toilet bowl 2 (near the rear end of the opening 2*a*). The first position adjusting unit 41 is fixed by inserting a fastener such as a screw or the like into the toilet bowl 2 along an arrow A1. A screw hole for fixing the first position adjusting unit 41 to the toilet bowl 2 is formed to be larger than a screw hole of the toilet bowl 2 in the front-back direction and the horizontal direction. For this reason, while adjusting the position to the toilet bowl 2 in the front-back direction and the horizontal direction, the first position adjusting unit 41 can be fixed to the toilet bowl 2.

The position of the first position adjusting unit 41 in the front-back direction is determined with reference to the front end of the toilet bowl 2. That is, the first position adjusting unit 41 is fixed to the toilet bowl 2 at a position separated by a prescribed distance from the front end in the front-back direction. The first position adjusting unit 41 is fixed to the toilet bowl 2 at a center position of the toilet bowl 2 in the horizontal direction.

Next, the second position adjusting unit 42 is fixed to near the rear end of the toilet bowl 2. The second position adjusting unit 42 is fixed by inserting the screw or the like into the toilet bowl 2 along an arrow A3 as shown in FIG. 5. A screw hole for fixing the second position adjusting unit 42 to the toilet bowl 2 is formed to be larger than the screw hole of the toilet bowl 2 in the horizontal direction. For this reason, while adjusting the position to the toilet bowl 2 in the horizontal direction, the second position adjusting unit 42 can be fixed to the toilet bowl 2.

The position of the base plate 10 to the toilet bowl 2 in the front-back direction fixed later is adjusted by the first position adjusting unit 41. Therefore, it is not necessary for the second position adjusting unit 42 to adjust the position in the front-back direction. As a result, the position relationship in the front-back direction is changeable between the base plate 10 and the second position adjusting unit 42. For this reason, the screw hole of the base plate 10 for fastening the second position adjusting unit 42 is formed to be larger than the screw hole of the second position adjusting unit 42 in the front-back direction.

The first position adjusting unit 41 includes a spacer 41*a* and a washer W as shown in FIG. 4. The second position adjusting unit 42 includes a washer W as shown in FIG. 5. In these position adjusting unit, the washer W may be provided in a plurality. By changing the number of the washers W included in the first position adjusting unit 41 and the second position adjusting unit 42, the position of the base plate 10 to the toilet bowl 2 in the vertical direction can be adjusted.

By adjusting the number of the washers W between the first position adjusting unit 41 and the second position adjusting unit 42, it is also possible to adjust the inclination of the base plate 10 in the front-back direction. Furthermore, the first position adjusting unit 41 and the second position adjusting unit 42 are provided with the washers W at two points in the horizontal direction, respectively. Therefore, in the respective position adjusting unit, by adjusting the number of the washers W in right and left, the inclination of the base plate 10 in the horizontal direction can be adjusted.

Heights of the first position adjusting unit 41 and the second position adjusting unit 42 are adjusted so that a gap between the left side part 12*a* and the upper surface S1 and a gap between the right side part 12*b* and the upper surface S2 are small when providing the case plate 12 later.

The position adjustment of the first position adjusting unit 41 and the second position adjusting unit 42 in the respective directions can be performed by using a jig, respectively. The configuration of the jig can be appropriately changed depending on the specific structures of the sanitary washing device 1 and the toilet bowl 2. Here, only the jig for performing the position adjustment in the vertical direction of the first position adjusting unit 41 and the second position adjusting unit 42 is illustrated.

In the jig for performing the position adjustment in the vertical direction of the first position adjusting unit 41 and the second position adjusting unit 42, for example, two plate-like members are concatenated and configured to be pivotally rotatable each other. First, the first member is placed on the upper surface around the opening 2*a* of the toilet bowl 2, starting from the front end of the toilet bowl 2. Next, the second member is placed on the upper surface S1 and the upper surface S2 in the backward. Subsequently, the gaps between the upper surfaces of the toilet bowl 2 and the respective members are investigated, and thus it is possible to investigate a difference in height between the left and right of the toilet bowl 2. The number of the washers W in the left and right of the first position adjusting unit 41 and the second position adjusting unit 42 is adjusted so as to compensate the difference in height between the left and right.

The position of the second members in the vertical direction is taken as a reference, and the number of the washers W is adjusted in order to fix the second position adjusting unit 42 at the position separated by a prescribed distance from the second member in the vertical direction. Here, the front ends E1 and E2 of the case plate 12 are placed on the upper surfaces S1 and S2 of the toilet bowl 2 as described above. For this reason, if the position of the second position adjusting unit 42 in the vertical direction is determined, as shown in FIG. 6, a reference plane P where the case plate 12 is to be fixed is determined by the second position adjusting unit 42 and a portion where and the front ends E1 and E2 of the case plate 12 are placed on the toilet bowl 2. The position of the first position adjusting unit 41 in the vertical direction is adjusted so that the upper surface of the first position adjusting unit 41 is along the reference plane P.

Next, the base plate 10 is fixed to the toilet bowl 2. The front part of the base plate 10 is fixed by inserting the screw or the like into the toilet bowl 2 through the spacer 41*a* and the washer W along an arrow A5 as shown in FIG. 4. The rear part of the base plate 10 is fixed by inserting the screw or the like into the second position adjusting unit 42 along an arrow A7 as shown in FIG. 5. The position adjustments of the first position adjusting unit 41 and the second position adjusting unit 42 to the toilet bowl 2 are already performed. For this reason, the base plate 10 is fixed to the toilet bowl 2 at the prescribed position by fixing the base plate 10 to the toilet bowl 2 via the position adjusting unit.

The pivotally supporting unit 20 is fixed to the base plate 10. The toilet seat 31 and the toilet lid 32 are pivotally supported to the pivotally supporting unit 20. Therefore, if the base plate 10 is fixed to the toilet bowl 2, the toilet seat 31 and the toilet lid 32 are also fixed simultaneously to the toilet bowl at the prescribed position. As described above, the position of the first position adjusting unit 41 to the toilet bowl is adjusted with reference to widths of the front end and in the left and right of the toilet bowl 2. In this way, the toilet seat 31 and the toilet lid 32 are positioned at a center of the toilet bowl 2 in the horizontal direction, and these pointed ends can be coincided with the front end of the toilet bowl 2.

Next, as shown in FIG. 2, the third position adjusting unit 43 is fixed onto the base plate 10 in the forward of the pivotally supporting unit 20. A screw hole for fixing the third position adjusting unit 43 to the base plate 10 is formed to be larger than the screw hole of the base plate 10 in the front-back direction. For this reason, while adjusting the position to the base plate 10 in the front-back direction, the third position adjusting unit 43 can be fixed to the base plate 10. The third position adjusting unit 43 is fixed to the base plate 10 at the position separated from the rear end by a prescribed distance with reference to the rear end of the opening 2*a* of the toilet bowl 2.

Next, the case plate 12 mounting the not shown function part such as the washing function part is fixed onto the base plate 10. A recess portion engaging with the third position adjusting unit 43 is formed on a bottom surface of the case plate 12. While engaging the recess portion with the third position adjusting unit 43, the case plate 12 is fixed to the base plate 12 by the screw or the like. The case plate 12 is fixed to the base plate 10 via the third position adjusting unit 43, and thus the case plate 12 can be fixed at the prescribed position to the rear end of the opening 2*a* of the toilet bowl 2. Thereby, when the washing function part on the case plate 12 advances into the opening 2*a*, it is possible to make variation of the position of the washing function part to the toilet bowl 2 small and improve usability of the sanitary washing device 1.

At this time, the inclination of the base plate 10 in the front-back direction and the horizontal direction is adjusted by the first position adjusting unit 41 and the second position adjusting unit 42. For this reason, when the case plate 12 is fixed onto the base plate 10, the side parts 12*a* and 12*b* of the case plate 12 can be provided along the upper surfaces S1 and S2 of the toilet bowl 2. Thereby, the gap between them can be small.

Next, the cover plate 14 is fixed onto the case plate 12 by the screw or the like. The function part mounted on the case plate 12 is covered with the cover plate 14 from upward.

Next, as shown in FIG. 3, the fourth position adjusting unit 44 is fixed onto the base plate 10 in the backward of the pivotally supporting unit 20. A screw hole for fixing the fourth position adjusting unit 44 to the base plate 10 is formed to be larger than the screw hole of the base plate 10 in the front-back direction. For this reason, while adjusting the position to the base plate 10 in the front-back direction, the fourth position adjusting unit 44 can be fixed to the base plate 10.

The fourth position adjusting unit 44 is adjusted with reference to the back surface of the toilet bowl 2. Specifically, a step between the surface of the back cover 16 and the back surface of the toilet bowl 2 is made small, and the position of the fourth position adjusting unit 44 in the front-back direction is adjusted so that these surfaces are smoothly continued.

After the fourth position adjusting unit 44 is fixed to the base plate 10, the back cover 16 is attached backward the fourth position adjusting unit 44. That is, the back cover 16 is attached to the base plate 10 via the fourth position adjusting unit 44.

The sanitary washing device 1 according to the embodiment is obtained by the above assembly process. The toilet apparatus 100 including sanitary washing device 1 according to the embodiment assembled on the toilet bowl 2 is obtained by the above assembly process.

The first position adjusting unit 41 to the fourth position adjusting unit 44 shown in FIG. 2 to FIG. 6 are just only one example. The shape and the configuration are possible to be appropriately changed depending on the configuration and the shape of the sanitary washing device 1 and the toilet bowl 2.

As described above, in the sanitary washing device 1 and the method for assembling the same according to the embodiment, the position of the base plate 10 to the toilet bowl 2 and the positions of the case plate 12 and the back cover 16 to the base plate 10 can be adjusted by the first position adjusting unit 41 to the fourth position adjusting unit 44. By adjusting these positions, it is possible to make the gap between the sanitary washing device 1 and the toilet bowl 2 small, enhance the sense of unity between the sanitary washing device 1 and the toilet bowl 2, and to improve the appearance.

Furthermore, the inclination of the base plate 10 to the toilet bowl 2 in the front-back direction and the horizontal direction can be adjusted by the first position adjusting unit 41 and the second position adjusting unit 42. Thereby, the gap between the sanitary washing device 1 and the toilet bowl 2 can be made small, and the appearance of the sanitary washing device 1 can be more improved. It is possible to perform the position adjustment more easily and accurately by using the first position adjusting unit 41 to the fourth position adjusting unit 44 for position adjustment of the respective configurational elements.

With respect to the gap between the respective configurational elements of the sanitary washing device 1 and the toilet bowl 2, the toilet bowl increases in size and becomes large as the shape becomes more complicated. This is because that the variation of the size of the toilet bowl 2 and the variation of the shape increase as the toilet bowl 2 becomes large and the shape becomes more complicated. For example, as shown in FIG. 1 to FIG. 3, in the case where the side part of the toilet bowl 2 is raised towards the backward, the size of the toilet bowl 2 and the variation of the shape increase as well.

However, according to the embodiment, the gap between the sanitary washing device 1 and the toilet bowl 2 can be small. For this reason, the invention according to the invention is particularly effective to the case where the sanitary washing device 1 is provided on the toilet bowl 2 as shown in FIG. 1 to FIG. 3. The variation of the size of the toilet bowl 2 and the variation of the shape becomes more remarkable in the case where the toilet bowl 2 is formed of pottery. Therefore, the invention according to the embodiment is particularly effective to the toilet bowl made of pottery.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the sanitary washing device 1 are not limited to illustrations and can be changed appropriately.

The components included in the embodiments described above can be combined to the extent possible, and these combinations are also encompassed within the scope of the invention as long as they include the features of the invention.

What is claimed is:

1. A sanitary washing device comprising:

a base plate fixed to a rear part of a toilet bowl;

a case plate mounting a washing function part washing a private part of a human body, the case plate being fixed onto the base plate;

a cover plate covering the washing function part from upward and being fixed onto the case plate;

a pivotally supporting unit including a first pivotally supporting part pivotally supporting a toilet seat and a second pivotally supporting part pivotally supporting a toilet lid, the pivotally supporting unit being fixed to the base plate in a backward of the case plate; and a back cover provided backward the pivotally supporting unit, a front part and a rear part of the base plate being fixed respectively to the toilet bowl via a first position adjusting unit and a second position adjusting unit, the first position adjusting unit and the second position adjusting unit being capable of adjusting a position of the base plate to the toilet bowl, the case plate being fixed to the base plate via a third position adjusting unit capable of adjusting a position of the case plate to the base plate, a fourth position adjusting unit capable of adjusting a position of the back cover to the base plate being provided between the pivotally supporting unit and the back cover, and the back cover being attached to the fourth position adjusting unit.

2. The sanitary washing device according to claim 1, wherein the first position adjusting unit and the second position adjusting unit are further capable of adjusting an inclination in a front-back direction of the base plate to the toilet bowl.

3. The sanitary washing device according to claim 2, wherein the first position adjusting unit and the second position adjusting unit are further capable of adjusting an inclination in a horizontal direction of the base plate to the toilet bowl.

4. The sanitary washing device according to claim 1, wherein the first position adjusting unit and the second position adjusting unit are further capable of adjusting an inclination in a horizontal direction of the base plate to the toilet bowl.

5. A method for assembling a sanitary washing device comprising:

fixing a base plate to a rear part of a toilet bowl while adjusting a position of the base plate to a toilet bowl, a pivotally supporting unit being fixed to the base plate, the pivotally supporting unit including a first pivotally supporting part pivotally supporting a toilet seat and a second pivotally supporting part pivotally supporting a toilet lid;

fixing a case plate onto the base plate in a frontward of the pivotally supporting unit while adjusting a position of the case plate to the base plate, a washing function part washing a private part of a human body being mounted on the case plate;

fixing a cover plate onto the case plate, the cover plate covering the washing function part from upward; and providing a back cover backward the pivotally supporting unit while adjusting a position of the back cover to the base plate, wherein in the adjusting the position of the case plate to the base plate, a third position adjusting unit is fixed onto the base plate in the forward of the pivotally supporting unit while adjusting the position of the case plate to the base plate, and the case plate is fixed to the base plate via the third position adjusting unit.

6. The method for assembling the sanitary washing device according to claim 5, wherein in the adjusting the position of the base plate to the toilet bowl, a first position adjusting unit and a second position adjusting unit are respectively fixed to a front part and a rear part of the toilet bowl, while adjusting the position of the base plate to the toilet bowl, and the base plate is fixed to the toilet bowl via the first position adjusting unit and the second position adjusting unit.

7. The method for assembling the sanitary washing device according to claim 6, wherein an inclination of the base plate is adjusted by the first position adjusting unit and the second position adjusting unit, the inclination being in a front-back direction and a horizontal direction of the base plate to the toilet bowl.

8. The method for assembling the sanitary washing device according to claim 5, wherein in the adjusting the position of the back cover to the base plate, a fourth position adjusting unit is fixed onto the base plate in the backward of the pivotally supporting unit while adjusting the position of the back cover to the base plate, and the back cover is attached to the fourth position adjusting unit.

9. A method for assembling a sanitary washing device comprising:

fixing a base plate to a rear part of a toilet bowl while adjusting a position of the base plate to a toilet bowl, a pivotally supporting unit being fixed to the base plate, the pivotally supporting unit including a first pivotally supporting part pivotally supporting a toilet seat and a second pivotally supporting part pivotally supporting a toilet lid;

fixing a case plate onto the base plate in a frontward of the pivotally supporting unit while adjusting a position of the case plate to the base plate, a washing function part washing a private part of a human body being mounted on the case plate;

fixing a cover plate onto the case plate, the cover plate covering the washing function part from upward; and providing a back cover backward the pivotally supporting unit while adjusting a position of the back cover to the base plate, wherein in the adjusting the position of the back cover to the base plate, a fourth position adjusting unit is fixed onto the base plate in the backward of the pivotally supporting unit while adjusting the position of the back cover to the base plate, and the back cover is attached to the fourth position adjusting unit.

10. The method for assembling the sanitary washing device according to claim 9, wherein in the adjusting the position of the base plate to the toilet bowl, a first position adjusting unit and a second position adjusting unit are respectively fixed to a front part and a rear part of the toilet bowl, while adjusting the position of the base plate to the toilet bowl, and the base plate is fixed to the toilet bowl via the first position adjusting unit and the second position adjusting unit.

11. The method for assembling the sanitary washing device according to claim 10, wherein an inclination of the base plate is adjusted by the first position adjusting unit and the second position adjusting unit, the inclination being in a front-back direction and a horizontal direction of the base plate to the toilet bowl.

* * * * *